US006609897B1

(12) United States Patent
Nakane et al.

(10) Patent No.: US 6,609,897 B1
(45) Date of Patent: Aug. 26, 2003

(54) MOTOR-OPERATED COMPRESSOR

(75) Inventors: Yoshiyuki Nakane, Kariya (JP); Susumu Tarao, Kariya (JP); Kenichi Morita, Kariya (JP); Kazuo Murakami, Kariya (JP); Shinya Yamamoto, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/831,990

(22) PCT Filed: Oct. 3, 2000

(86) PCT No.: PCT/JP00/06889

§ 371 (c)(1),
(2), (4) Date: May 15, 2001

(87) PCT Pub. No.: WO01/25636

PCT Pub. Date: Apr. 12, 2001

(30) Foreign Application Priority Data

Oct. 4, 1999 (JP) ..... 11-282530
Dec. 27, 1999 (JP) ..... 11-369693

(51) Int. Cl.[7] ..... F04B 1/12
(52) U.S. Cl. ..... 417/269; 417/222.2
(58) Field of Search ..... 417/269, 222.2

(56) References Cited

U.S. PATENT DOCUMENTS 6,068,452 A * 5/2000 Okada et al. ..... 417/223
6,280,151 B1 * 8/2001 Murakami et al. ..... 417/222.2
6,393,964 B1 * 5/2002 Katayama et al. ..... 92/154

FOREIGN PATENT DOCUMENTS

| | | |
|---|---|---|
| JP | 5-187356 A | 7/1993 |
| JP | 5-231311 A | 9/1993 |
| JP | 9-42156 A | 2/1997 |
| JP | 2596291 Y2 | 4/1999 |
| JP | 11-257219 A | 9/1999 |
| JP | 11-287182 A | 10/1999 |

* cited by examiner

*Primary Examiner*—Charles G. Freay
*Assistant Examiner*—Michael K. Gray
(74) *Attorney, Agent, or Firm*—Woodcock Washburn LLP

(57) ABSTRACT

A single-headed piston (22) is accommodated within each of a plurality of cylinder bores (13) formed on a cylinder block (13). Shoes (23) are disposed between a swash plate (11) and each single-headed piston (22). The rotation force of the swash plate (11) is transmitted to the single-headed piston (22) via the shoes (23). Each single-headed piston (22) makes a reciprocating motion within the cylinder bore (131) accompanied by the rotation of the swash plate (11). A rotary shaft (16) fixed to the swash plate (11) is driven by a motor (21).

9 Claims, 7 Drawing Sheets

MOTOR-OPERATED COMPRESSOR

TECHNICAL FIELD

The present invention relates to a compressor that accommodates a piston within each of a plurality of cylinder bores laid out around a rotary shaft, and that has shoes disposed between a swash plate that rotates integrally with the rotary shaft and each piston. The shoes are in a sliding contact with both the swash plate and the piston, thereby to reciprocally move the piston by transmitting the rotation force of the swash plate to the piston via the shoes.

BACKGROUND ART

In a compressor for reciprocally moving the piston based on a rotation of a swash plate that integrally rotates with the rotary shaft and that can change its inclination angle, it is possible to change a discharge capacity of this compressor. An example of a device for driving the rotary shaft of such a variable displacement type compressor by a motor has been disclosed in Japanese Unexamined Patent Publication No. 5-187356.

The device disclosed in Japanese Unexamined Patent Publication No. 5-187356 corresponds to what is called a wobble type. According to this device, a piston support makes an inclined movement based on the rotation of the swash plate so that the piston makes a reciprocating motion by this inclined movement. A compressive reaction force generated at the time of discharging a gas from each cylinder bore works on the reciprocating motion mechanism for reciprocally moving the piston. A mechanism of reciprocally moving the piston by transmitting the inclination movement of the rotating swash plate to the piston via the non-rotating piston support is complex. A guide groove is formed on a drive plate that is fixed to the rotary shaft, and a pivot pin fixed to the swash plate is engaged with the guide groove. A sleeve is slid ably supported by the rotary shaft. The sleeve supports the swash plate so that the swash plate can make an inclination movement via a sleeve pin that is formed on the sleeve. The inclination movement of the swash plate is guided by the engagement between the guide groove and the pivot pin and the sliding of the sleeve. The drive plate receives the compressive reaction force via the piston, the piston support, a thrust bearing, the swash plate and the pivot pin respectively.

In the case of driving the rotary shaft of the wobble-type variable-displacement type compressor by using a motor, it is essential to minimize the rotational friction between the swash plate and the piston support as far as possible. Otherwise, it is necessary to use a large motor having a large output, which results in a large compressor as a whole. Particularly, when carbon dioxide is used as a refrigerant, an extremely large compression is necessary at a high pressure. This generates a large frictional force. Therefore, it is essential to dispose a thrust bearing between the swash plate and the piston support. This structure increases the length of the compressor.

DISCLOSURE OF THE INVENTION

It is an object of the present invention to provide a compact motor-operated compressor.

In order to achieve this object, according to the present invention, there is provided a motor-operated compressor that accommodates a piston within each of a plurality of cylinder bores laid out around a rotary shaft, and that has a shoe disposed between a swash plate that rotates integrally with the rotary shaft and each piston so that the shoe is in a sliding contact with both the swash plate and the piston, thereby to reciprocally move the piston by transmitting the rotational force of the swash plate to the piston via the shoe, wherein the piston for making a reciprocating motion is a single-headed piston that discharges a gas from the cylinder bores only during a forward motion, and the rotary shaft is driven by a motor.

The structure of transmitting the rotational force of the swash plate to the single-headed piston via the shoe is advantageous for making compact the compressor that is driven by the motor.

The present invention will be more fully understood from the following description of preferred embodiments as well as the attached drawings of the present invention.

BEST MODE FOR CARRYING OUT THE INVENTION

A first embodiment of the present invention will be explained below with reference to FIG. 1 to FIG. 3.

Figure 1:
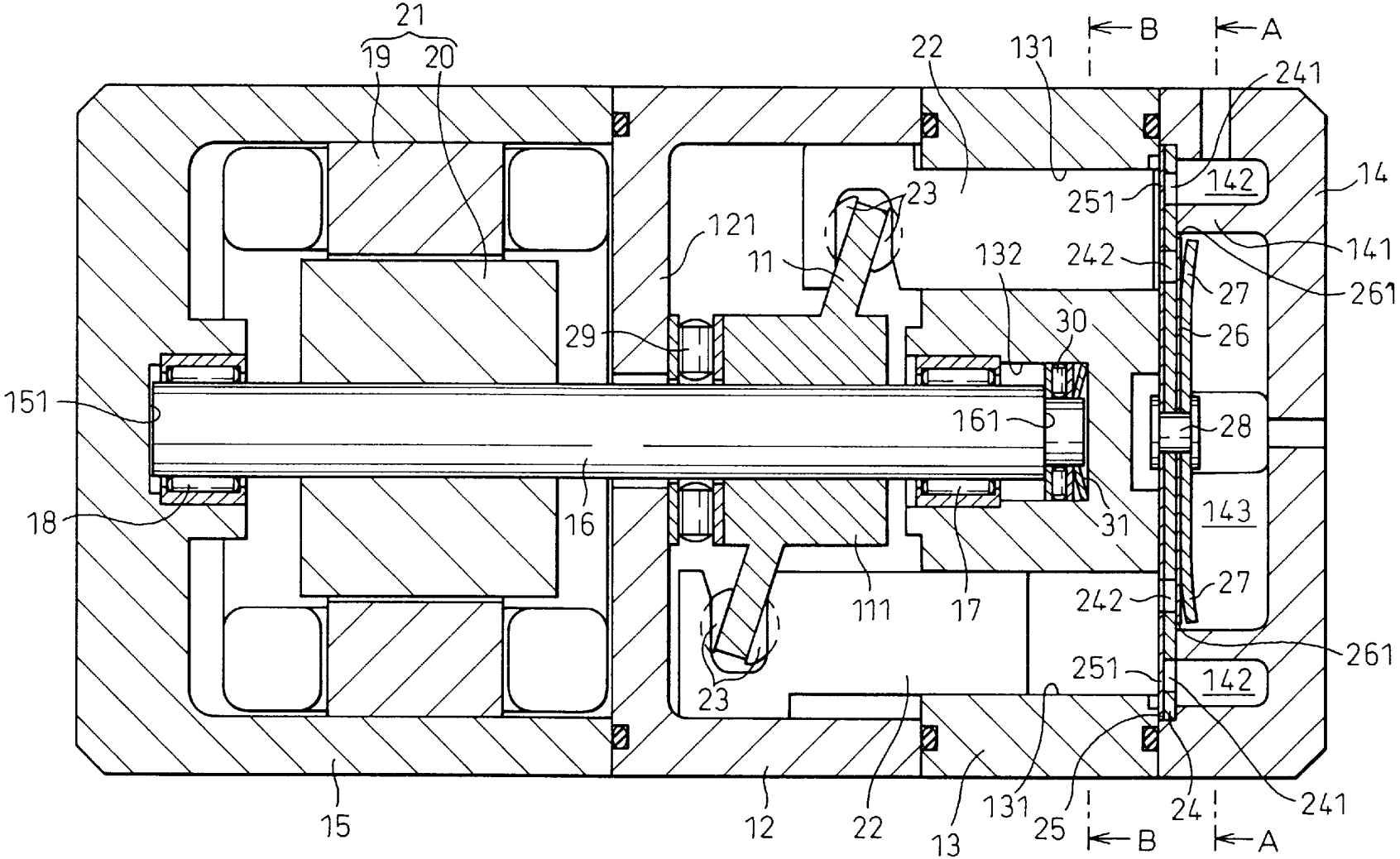
FIG. 1 is a side cross-sectional view of a compressor as a whole according to a first embodiment of the present invention.
Figure 2:
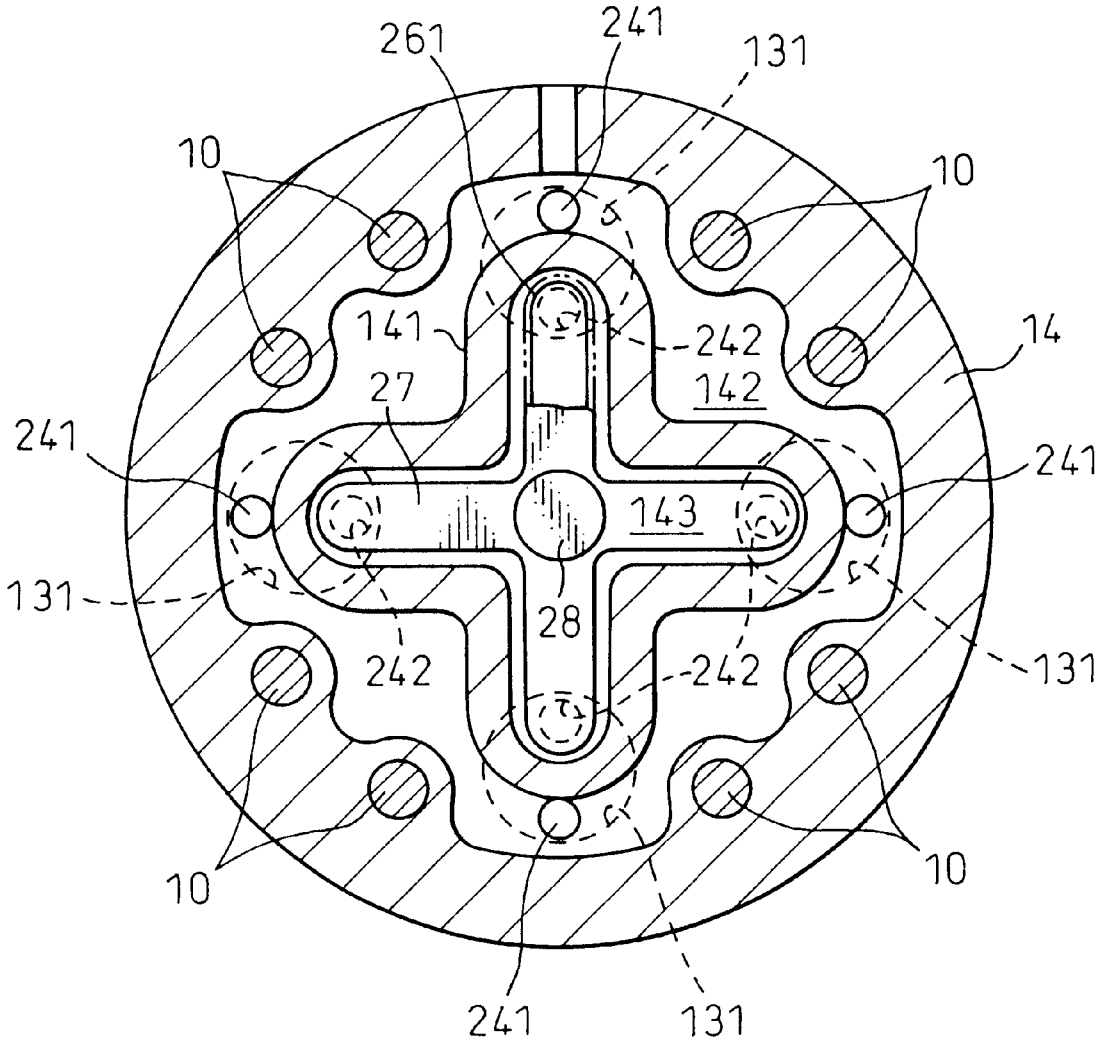
FIG. 2 is a cross-sectional view of the compressor cut along an A—A line in FIG. 1.

As shown in FIG. 1, a cylinder block 13 and a motor housing 15 are connected to a swash plate housing 12 that accommodates a swash plate 11. A chamber-forming housing 14 is connected to the cylinder block 13. The motor housing 15, the swash plate housing 12, the cylinder block 13, and the chamber-forming housing 14 are fixed together by the fastening of screws 10 (shown in FIG. 2 and FIG. 3). The motor housing 15 and the cylinder block 13 rotatable supports a rotary shaft 16 via radial bearings 17 and 18. The rotary shaft 16 plunges into a supporting hole 132 formed on the cylinder block 13. The radial bearing 17 supports the rotary shaft 16 within the supporting hole 132. The rotary shaft 16 passes through an end wall 121 of the swash plate housing 12, and into a supporting hole 151 formed on the motor housing 15. The radial bearing 18 supports the rotary shaft 16 within the supporting hole 151. The swash plate 11 is fixed to the rotary shaft 16 within the swash plate housing 12.

A stator 19 is fitted to the inner peripheral surface of the motor housing 15, and a rotor 20 is fixed to the rotary shaft 16 within the motor housing 15. The rotary shaft 16 is pressed into the rotor 20 having a cylindrical shape. It is needless to mention that a key engagement is provided to effect an integrated rotation of the rotor 20 and the rotary shaft 16. The rotor 20 rotates based on a current conduction to the stator 19, and the rotary shaft 16 integrally rotates with the rotor 20. The stator 19 and the rotor 20 constitute a motor 21.

Figure 3:
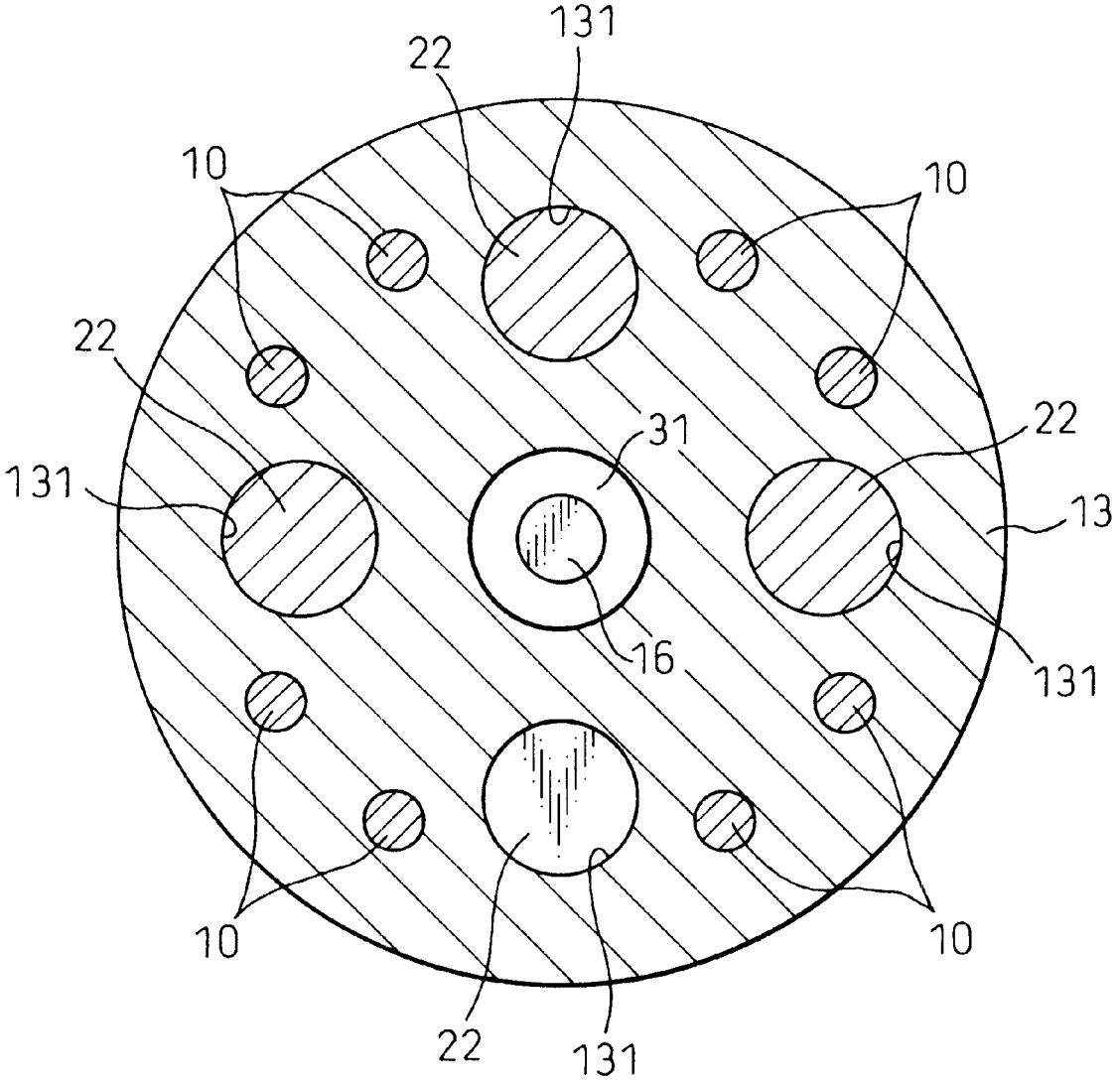
FIG. 3 is a cross-sectional view of the compressor cut along a B—B line in FIG. 1.

As shown in FIG. 3, a plurality of cylinder bores 131 are formed on the cylinder block 13. The plurality of cylinder bores 131 are laid out at equal intervals around the rotary shaft 16. A single-headed piston 22 is accommodated within each cylinder bore 131. As shown in FIG. 1, shoes 23 exist between the swash plate 11 and each single-headed piston 22. The rotational force of the swash plate 11 is transmitted to the single-headed piston 22 via the shoes 23, and each single-headed piston 22 makes a reciprocating motion within each cylinder bore 131 accompanied by the rotation of the swash plate 11.

As shown in FIG. 1, a valve plate 24 and a valve forming plate 25 are disposed between the chamber-forming housing 14 and the cylinder block 13. The space inside the chamber-forming housing 14 is separated into a suction chamber 142 and a discharge chamber 143 by a partition 141 inside the discharge chamber 143, a valve forming plate 26 and a retainer 27 are caulked on the valve plate 24 with a pin 28.

On the valve plate 24, a suction port 241 is formed corresponding to the suction chamber 142 and each cylinder bore 131. On the valve plate 24 and the valve forming plate 25, a discharge port 242 is formed corresponding to the discharge chamber 143 and each cylinder bore 131. A suction valve 251 is formed on the valve forming plate 25, and a discharge valve 261 is formed on the valve forming plate 26. The suction valve 251 opens and closes the suction port 241, and the discharge valve 261 opens and closes the discharge port 242.

The refrigerant within the suction chamber 142 pushes aside the suction valve 251 based on a backward motion of each single-headed piston 22 (a move from the right to the left in FIG. 1), and flows into each cylinder bore 131 through the suction port 241. The refrigerant that has flown into each cylinder bore 131 pushes aside the discharge valve 261 based on a forward motion of the single-headed piston 242 (a move from the left to the right in FIG. 1), and is discharged to the discharge chamber 143 through the discharge port 242. The discharge valve 261 is brought into contact with the retainer 27, and the retainer 27 restricts the degree of the opening of the discharge valve 261. The suction chamber 142 and the discharge chamber 143 are connected together by an external refrigerant circuit not shown. The refrigerant that has flown out of the discharge chamber 143 into the external refrigerant circuit flows back to the suction chamber 142 through a condenser, an expansion valve, and an evaporator disposed on the external refrigerant circuit. Carbon dioxide is used as the refrigerant in the present embodiment.

A thrust bearing 29 exists between a cylindrical base 111 of the swash plate 11 and an end wall 121 of the swash plate housing 12. The thrust bearing 29 surrounds the rotary shaft 16. When the refrigerant is discharged from each cylinder bore 131 to the discharge chamber 143 based on a forward motion of each single-headed piston 22, the end wall 121 receives the compressive reaction force through the single-headed piston 22, the shoes 23, the swash plate 11, and the thrust bearing 29.

A step 161 is formed at the end of the rotary shaft 16 that plunges into the supporting hole 132. A thrust bearing 30 and a belleville spring 31 exist between the step 161 and the bottom surface of the supporting hole 132. The spring force of the belleville spring 31 biases the rotary shaft 16 toward the motor housing 15 via the thrust bearing 30. The end wall 121 receives the spring force of the belleville spring 31 via the thrust bearing 30, the rotary shaft 16, the swash plate 11, and the thrust bearing 29.

According to the first embodiment, it is possible to obtain the following effects.

(1) It is possible to make compact the compressor that drives the rotary shaft 16 for rotating the swash plate 11 by the motor 21, based on a compact structure of the internal mechanism of the swash plate housing 12. The mechanism of transmitting the rotational force of the swash plate 11 via the shoes that are in contact with both the single-headed piston 22 and the swash plate 11 is a very compact mechanism for reciprocally moving the single-headed piston 22. Therefore, the structure of transmitting the rotational force of the swash plate 11 to the single-headed piston 22 via the shoes 23 is advantageous for providing a compact compressor driven by the-motor 21.

(2) The swash plate 11 is fixed to the rotary shaft 16, and the inclined angle of the swash plate 11 with respect to the rotary shaft 16 is invariable. Therefore, the compressor having no mechanism for making an inclination movement of the swash plate 11 is advantageous for providing a compact motor-operated compressor.

(3) The thrust bearing 29 that is provided at the opposite side of the cylinder bores 131 with the swash plate 11 as a boundary within the swash plate housing 12 receives the compressive reaction force when the single headed piston 22 makes a forward motion. A suction pressure is being applied to each cylinder bore 131 that accommodates each single-headed piston 22 that is making a backward motion, and the pressures within the plurality of cylinder bores 131 are not the same. Therefore, the swash plate 11 receives a localized load based on the compressive reaction force. This localized load tends to bend the rotary shaft 16. The bending of the rotary shaft 16 damages the radial bearings 17 and 18, and this becomes the cause of a generation of abnormal sound. The thrust bearing 29 located at a position where the thrust bearing 29 is in contact with the base 111 of the swash plate 11 receives the localized load, and this prevents the rotary shaft 16 from being bent due to the localized load.

(4) The thrust bearing 29 that has the end wall 121 of the swash plate housing 12 close to the base 111 of the swash plate 11 as a receiver is optimum load receiving means for preventing the rotary shaft 16 from being bent.

(5) The belleville spring 31 that becomes the pre load adding means biases the swash plate 11 toward the thrust bearing 29 via the thrust bearing 30 and the rotary shaft 16. The thrust bearing 29 receives the pre load that has been applied to the swash plate 11 by the belleville spring 31. Therefore, the spring force of the belleville spring 31 prevents the:swash plate 11 from being loosened in the axial direction of the rotary shaft 16.

(6) Carbon dioxide that can be used as the refrigerant is used at an extremely high pressure as compared with the, CC refrigerant. The use of the high-pressure refrigerant makes it possible to decrease the volume of the cylinder bores 131, or to decrease the discharge capacity, without lowering the refrigeration capacity of the external refrigerant circuit. A certain level of high-speed rotation is necessary while not lowering the refrigeration capacity even at a small capacity. The motor 21 is suitable to meet this condition. The compressor that uses the single-headed piston 22 for compressing the refrigerant on one face of the swash plate 11 has a smaller discharge capacity than the compressor that uses a two-headed piton for compressing the refrigerant on both surfaces of the swash plate 11. However, the compressor using the single-headed piston 22 has a smaller size. Carbon dioxide is preferable as the refrigerant in the motor-operated compressor using the single-headed piston 22 that is advantageous for providing a compact compressor.

Figure 4:
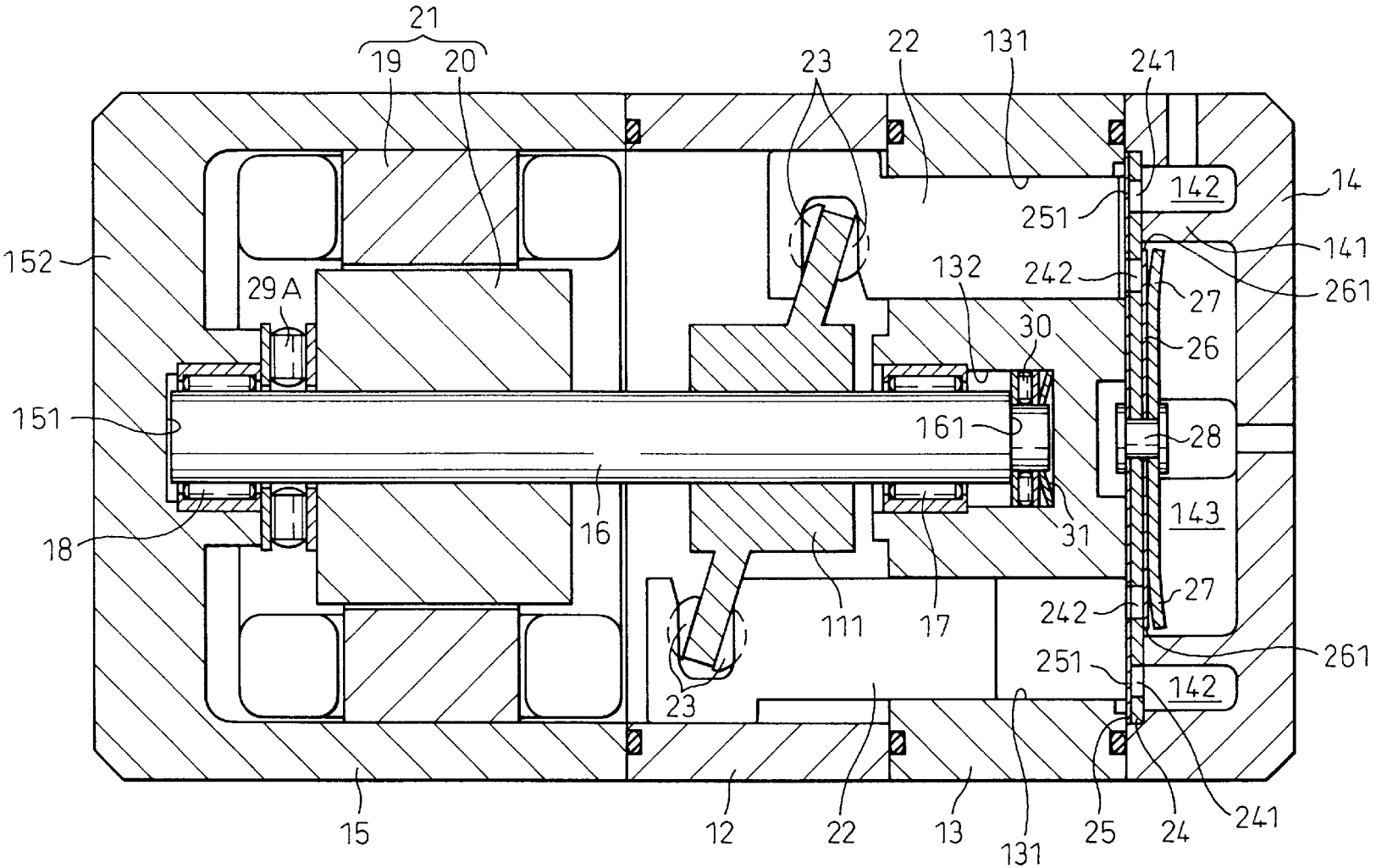
FIG. 4 is a side cross-sectional view of a compressor as a whole according to a second embodiment of the present invention.

Next, a second embodiment of the present invention will be explained with reference to FIG. 4. In FIG. 4, constituent elements that are identical with those of the first embodiment have like reference numbers attached.

In this embodiment, thrust bearing 29A that becomes the thrust load receiving means is provided within the motor housing 15. The thrust bearing 29A exists between the end wall 152 of the motor housing 15 and the end surface of the rotor 20. The compressive reaction force when the single-headed piston 22 makes a forward motion is transmitted to the thrust bearing 29A via the swash plate 11, the rotary shaft 16, and the rotor 20. The thrust bearing 29A receives the compressive reaction force when the single-headed piston 22 makes the forward motion. The spring force of the Belleville spring 31 is transmitted to the thrust bearing 29A via the rotary shaft 16 and the rotor 20, and the thrust bearing 29A receives the spring force of the belleville spring 31.

The thrust bearing 29A is built in a space within the motor housing 15. The motor housing 15 does not become larger than that of the first embodiment. On the other hand, a member for supporting the thrust bearing 29 required in the first embodiment is unnecessary in the second embodiment, as the thrust bearing 29 is not required in the second embodiment. Therefore, the end wall 121 that is required in the first embodiment is unnecessary in the second embodiment. As a result, the swash plate housing 12 becomes smaller. Therefore, the thrust bearing 29A that uses the end wall 152 of the motor housing 15 as the receiver is thrust load receiving means suitable for providing a compact motor-operated compressor.

Figure 5:
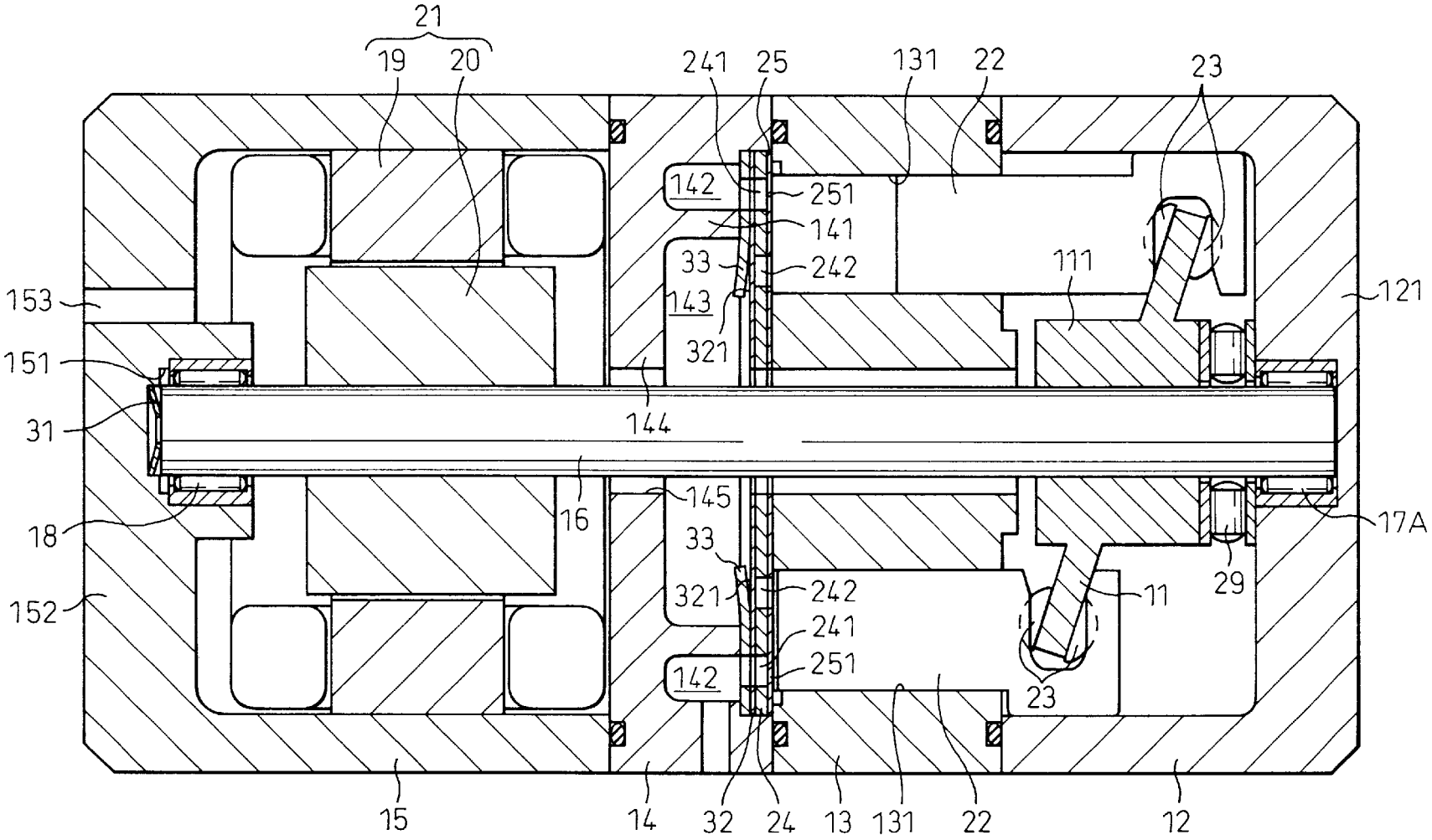
FIG. 5 is a side cross-sectional view of a compressor as a whole according to a third embodiment of the present invention.

Next, a third embodiment of the present invention will be explained with reference to FIG. 5. In FIG. 5, constituent elements that are identical with those of the first embodiment have like reference numbers attached.

In this embodiment, the motor housing 15 is connected to the chamber-forming housing 14. The rotary shaft 16 passes through the end wall 144 of the chamber-forming housing 14, the valve plate 24, and the cylinder block 13. The rotary shaft 16 is rotatable supported by the end wall 121 of the swash plate housing 12 via a radial bearing 17A, and is also rotatable supported by the end wall 152 of the motor housing 15 via a radial hearing 18. A reference number 321 denotes a discharge valve formed on the valve forming plate 32, and 33 denotes a retainer for restricting the degree of the opening of the discharge valve 321. A belleville spring 31 that becomes a pre load adding means is disposed between the bottom surface of the supporting hole 151 of the motor housing 15 and the end surface of the rotary shaft 16.

During a backward motion of each single-headed piston 22 (a move from the left to the right in FIG. 5), the refrigerant (carbon dioxide) within the suction chamber 142 flows into each cylinder bore 131 through the. retainer 33, the valve forming plate 32, and the suction port 241 that are formed on the valve plate 24. During a forward motion of the single-headed piston 22 (a move from the right to the left in FIG. 5), the refrigerant within the cylinder bore 131 is discharged to the discharge chamber 143 via the discharge port 242. The refrigerant within the discharge chamber 143 flows out into the external refrigerant circuit through a through hole 145 on the end wall 144 of the chamber-forming housing 14, the space inside the motor housing 15, and a discharge passage 153 on the end wall 152. The thrust bearing 29 receives the compressive reaction force generated by the forward motion of the single-headed piston 22 and the spring force of the belleville spring 31.

According to this embodiment, it is possible to obtain effects similar to those of the first embodiment. Further, the temperature of the refrigerant sent from the discharge chamber 143 to the inside of the motor housing 15 is lower than the temperature of the motor 21. Therefore, there is an advantage that the motor 21 is cooled by the discharge refrigerant.

Figure 6:
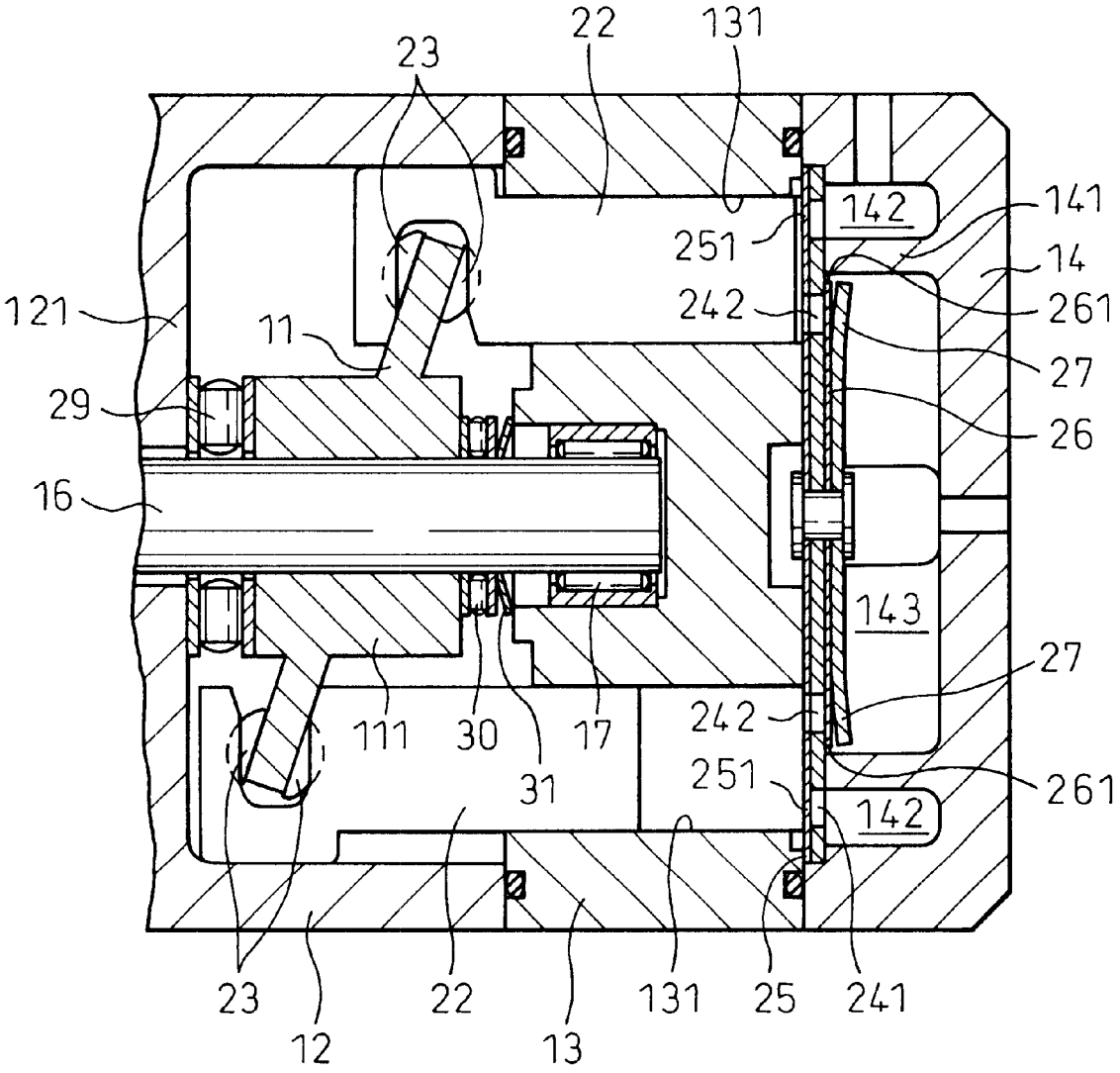
FIG. 6 is a cross-sectional view of a key portion of a compressor according to a fourth embodiment of the present invention.

Next, a fourth embodiment of the present invention will be explained with reference to FIG. 6. In FIG. 6, constituent elements that are identical with those of the first embodiment have like reference numbers attached.

In this embodiment, the belleville spring 31 as the preload adding means and the thrust bearing 30 are disposed between the end surface of the cylinder block 13 and the base 111 of the swash plate 11. The spring force of the belleville spring 31 directly presses the swash plate 11 toward the thrust bearing 29 to abut each other. Therefore, it is possible to employ such a structure that the swash plate 11 can slide to the axial direction of the rotary shaft 16 and the swash plate 11 integrally rotates with the rotary shaft 16.

Figure 7:
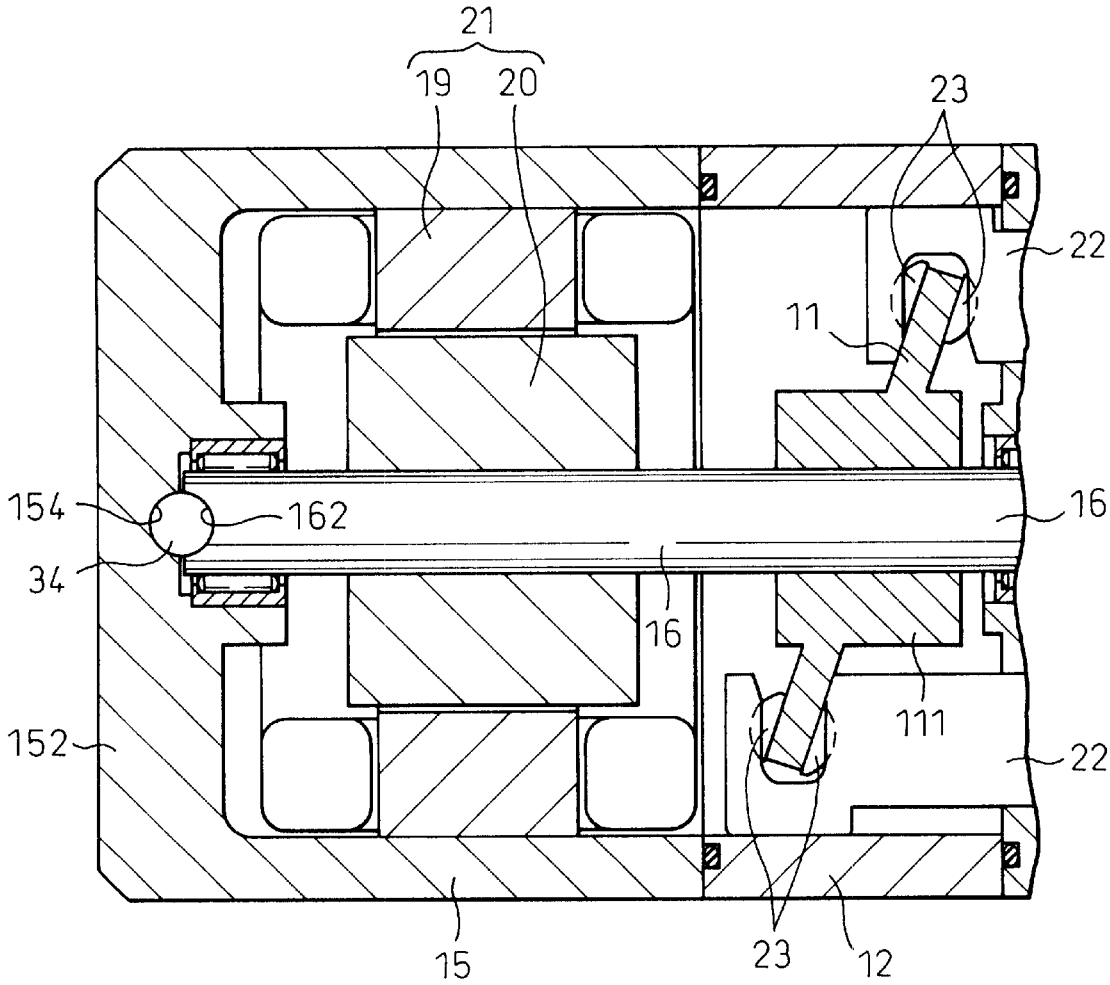
FIG. 7 is a cross-sectional view of a key portion of a compressor according to a fifth embodiment of the present invention.

Next, a fifth embodiment of the present invention will be explained with reference to FIG. 7. In FIG. 7, constituent elements that are identical with those of the first embodiment have like reference numbers attached.

In this embodiment, a semispherical supporting recess 154 is formed on the end wall 152 of the motor housing 15, and a semispherical supporting recess 162 is formed on the end surface of the rotary shaft 16. A sphere 34 is provided rotatable between the supporting recesses 154 and 162. The sphere 34 receives the compressive reaction force and the spring force of the belleville spring 31 via the rotary shaft 16. The sphere 34 disposed within the motor housing 15 becomes thrust load receiving means.

In this embodiment, it is also possible to obtain effects similar to those of the second embodiment.

According to the present invention, it is also possible to implement the following embodiments.

(1) In the third embodiment, the radial bearing 17A may be disposed between the cylinder block 13 and the rotary shaft 16. Based on this arrangement, it is possible to shorten the length of the rotary shaft 16 to shorten the length of the motor-operated compressor.

(2) It is also possible to apply the present invention to a variable displacement type compressor disclosed in Japanese Unexamined Patent Publication No. 11-180138. In other words, it is possible to apply the invention to a compressor in which an inclinable swash plate integrally rotates with a rotary shaft, and the rotation force of the swash plate is transmitted to a single-headed piston via shoes.

As explained in detail above, according to the present invention, a rotary shaft is driven by a motor in a compressor that reciprocally moves a single-headed piston by transmitting the rotation force of a swash plate to the piston via shoes. Therefore, there is an excellent effect that it is possible to make compact the motor-operated compressor.

While the detailed description has been made above for specific embodiments of the present invention, a person skilled in the art can make various modifications and corrections to the above without deviating from the scope of claim and idea of the present invention.

What is claimed is:

1. A motor-operated compressor that accommodates a piston within each of a plurality of cylinder bores laid out around a rotary shaft, and that has a shoe disposed between a swash plate that rotates integrally with said rotary shaft and each piston so that said shoe is in a sliding contact with both said swash plate and said piston, thereby to reciprocally move said piston by transmitting the rotational force of said swash plate to the piston via said shoe, wherein said piston for making a reciprocating motion is a single-headed piston that discharges a gas from said cylinder bores only during a forward motion, and said rotary shaft is driven by a motor, and wherein said motor is accommodated within a motor housing, a thrust load receiving member is provided within said motor housing, and said thrust load receiving member receives the compressive reaction force when said single-headed piston makes a reciprocating motion.

2. The motor-operated compressor according to claim 1, wherein said swash plate has an invariable is inclined angle with respect to said rotary shaft.

3. The motor-operated compressor according to claim 1, wherein said thrust loading receiving member is a thrust bearing.

4. The motor-operated compressor according to claim 1, wherein there is provided a pre load adding member that biases said swash plate toward said thrust load receiving means, and said thrust load receiving means receives pre load added to said swash plate by said pre load adding means.

5. The motor-operated compressor according to claim 1, wherein said gas is carbon dioxide.

6. A motor-operated compressor that accommodates a piston within each of a plurality of cylinder bores laid out around a rotary shaft, and that has a shoe disposed between a swash plate that rotates integrally with said rotary shaft and each piston so that said shoe is in a sliding contact with both said swash plate and said piston, thereby to reciprocally move said piston by transmitting the rotational force of said swash plate to the piston via said shoe, wherein said piston for making a reciprocating motion is a single-headed piston that discharges a gas from said cylinder bores only during a forward motion, and said rotary shaft is driven by a motor, said swash plate is accommodated within a swash plate housing and has an invariable inclined angle with respect to said rotary shaft, a thrust load receiving member is provided at a side opposite to said cylinder bores within said swash plate housing, said thrust load receiving member receives the compressive reaction force when said single-headed piston makes a reciprocating motion, and a preload adding member that biases said swash plate toward said thrust load receiving member, and said thrust load receiving member receives a preload added to said swash plate by said preload adding member.

7. The motor-operated compressor according to claim 6, wherein said thrust load receiving member is a thrust bearing.

8. The motor-operated compressor according to claim 6, wherein said gas is carbon dioxide.

9. The motor-operated compressor according to claim 6, wherein said preload adding member is a spring disposed proximate one end of said rotary shaft.

* * * * *